United States Patent [19]

Zaiser

[11] Patent Number: 4,773,827

[45] Date of Patent: Sep. 27, 1988

[54] LIQUID HEATING APPARATUS WITH TEMPERATURE CONTROL SYSTEM

[75] Inventor: Gary C. Zaiser, Milwaukee, Wis.

[73] Assignee: Hydro-thermal Corporation, Milwaukee, Wis.

[21] Appl. No.: 76,878

[22] Filed: Jul. 23, 1987

[51] Int. Cl.[4] ..... F04F 5/48

[52] U.S. Cl. ..... 417/183; 417/187; 417/197; 261/39.1

[58] Field of Search ..... 417/54, 182, 183, 184, 417/187–191, 197; 261/39.1, DIG. 13, DIG. 76

[56] References Cited

U.S. PATENT DOCUMENTS

| | | | |
|---|---|---|---|
| 2,124,620 | 7/1938 | Kirgan | 417/189 |
| 2,397,870 | 4/1946 | Kneass, Jr. | 417/189 X |
| 2,483,426 | 10/1949 | Moore | 261/DIG. 76 X |
| 2,530,638 | 11/1950 | White | 261/39.1 X |
| 2,539,280 | 1/1951 | Smith | 417/189 X |
| 2,676,575 | 4/1954 | Rosenberger | 417/183 X |
| 2,759,715 | 8/1956 | Alexander | 261/39.1 |
| 2,794,447 | 6/1957 | Spitz | 417/188 X |
| 4,184,806 | 1/1980 | Prinz | 417/183 X |
| 4,569,635 | 2/1986 | Nicodemus | 417/197 X |

FOREIGN PATENT DOCUMENTS

| | | | |
|---|---|---|---|
| 3044644 | 6/1982 | Fed. Rep. of Germany | 417/184 |
| 5411 | 1/1978 | Japan | 417/183 |

OTHER PUBLICATIONS

*Penberthy Company Bulletin No. RSH266,* "Penberthy Steam Ring Heater," received 4-20-1967.

*Primary Examiner*—Carlton R. Croyle
*Assistant Examiner*—Paul F. Neils
*Attorney, Agent, or Firm*—Andrus, Sceales, Starke & Sawall

[57] ABSTRACT

A liquid heating apparatus capable of using low pressure steam and having a temperature control system to automatically control the output temperature of a heated liquid. The apparatus includes a tubular housing having an internal annular seal, and a liquid nozzle, that is connected to a source of liquid to be heated, is mounted for axial movement in the housing relative to the seat. The annular space between the nozzle and the seat that defines an annular diverging passage which communicates with a source of steam under pressure. The steam is accelerated as it is discharged through the diverging passage into contact with the stream of liquid being discharged from the liquid nozzle. The liquid and steam then pass through a converging mixing chamber where the momentum energy of the steam transfers to the liquid as the steam condenses on the liquid. The mixture then passes into a diverging diffuser section and the heated liquid is discharged from the diffuser through a discharge conduit to a site of use. A power operated control mechanism is operably connected to the liquid nozzle for moving the nozzle within the housing to vary the cross sectional area of the steam outlet passage, and a temperature sensor is mounted in the discharge conduit for sensing the temperature of the discharged liquid and operating the control mechanism to regulate the input of steam to the aperture.

5 Claims, 2 Drawing Sheets

LIQUID HEATING APPARATUS WITH TEMPERATURE CONTROL SYSTEM

BACKGROUND OF THE INVENTION

It is known to inject steam onto a stream of water in a manner to condense the steam and transfer the energy of the steam to the water, thereby obtaining a high output pressure for the liquid, greater than the pressure of the incoming steam. For example, U.S. Pat. No. 4,569,635 is directed to a hydrokinetic amplifier, in which the kinetic energy of the steam is transferred to a liquid stream to obtain a large pressure amplification for the liquid. In accordance with the aforementioned patent, a stream of liquid is discharged through a nozzle into a converging acceleration chamber, and steam is injected into the acceleration chamber through a steam nozzle that surrounds the liquid nozzle. The steam nozzle has a throat region located upstream of the liquid nozzle and a diverging section extends from the throat of the steam nozzle to the liquid nozzle, causing acceleration of the steam to supersonic velocities.

The liquid stream, along with the surrounding steam, passes into the acceleration chamber and the momentum energy of the steam is transferred to the liquid as the steam contacts the liquid and condenses on the liquid surface. After flowing through the acceleration chamber, the liquid is then discharged through a diffuser section, which converts the liquid velocity to high pressure.

With the construction as shown in the aforementioned patent, the primary objective is to generate high liquid pressure and the position of the liquid nozzle is intended to be stationed relative to the steam nozzle to obtain the maximum pressure increase for the liquid.

Many industrial plants have residual low pressure steam from processing operations and it is desirable to use the steam for heating, particularly for heating water. However, with certain types of water heating devices, it is necessary that the steam pressure be greater than the water pressure in order to obtain proper operation of the heating device. In many instances, the water pressure in an industrial plant may be in the range of 30 to 60 psi, while the residual steam pressure may be only about 20 psi, making the heating devices unusable under those pressure conditions. Therefore, there has been a need for an inexpensive heating mechanism that can utilize low pressure steam.

SUMMARY OF THE INVENTION

The invention is directed to a liquid heating apparatus capable of using steam and having a temperature control system to automatically control the output temperature of the liquid.

The apparatus of the invention includes a tubular housing having an annular internal seat, and a liquid nozzle, connected to a source of liquid to be heated, is mounted for axial movement in the housing relative to the seat. The annular space between the liquid nozzle and the seat defines a steam outlet or nozzle which communicates with a source of steam under pressure.

Steam, being discharged from the steam nozzle, expands into a diverging chamber surrounding the liquid nozzle, to increase the velocity of the steam to supersonic levels.

The expanding high velocity steam then contacts the stream of liquid being discharged from the liquid nozzle in a converging mixing chamber wherein the steam condenses, thereby transferring momentum energy to the liquid and heating the liquid. After flowing through the mixing chamber, the liquid then expands into a diverging diffuser section where the high liquid velocity is converted to increased pressure. The heated liquid is then discharged from the diffuser section through a discharge conduit to a site of use.

A thermostat or temperature sensing means is located in the discharge conduit and senses the temperature of the discharged liquid. The thermostat operates a control mechanism which varies the position of the liquid nozzle relative to the seat on the housing which varies the cross-sectional area of the steam nozzle or outlet to regulate the amount of steam entering the housing and thus provide an accurate temperature control.

The heating apparatus of the invention enables low pressure residual steam, either at low superatmospheric pressure or subatmospheric pressure, to be utilized to heat a liquid and has particular application where the liquid is at a higher pressure than the steam. This results in a substantial economic advantage in plant operation.

As a further advantage, the discharge temperature of the liquid is accurately controlled by regulating the amount of steam being introduced into the apparatus.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
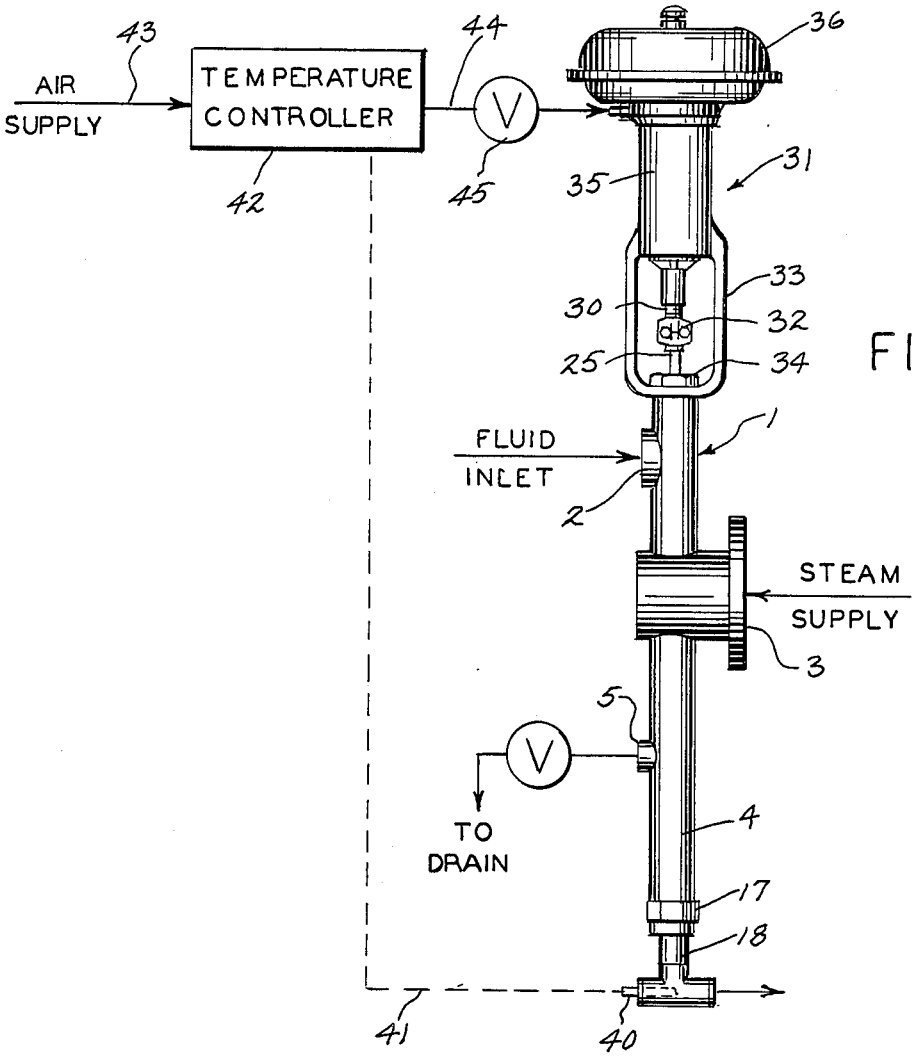
FIG. 1 is diagrammatic view of the heating apparatus of the invention utilizing a temperature control system.
Figure 3:
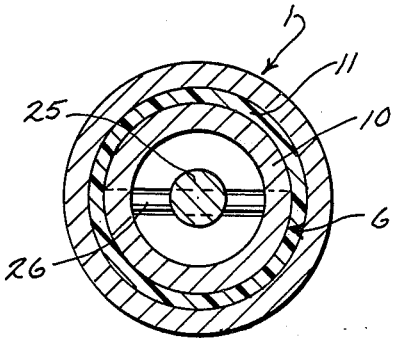
FIG. 3 is a section taken along line 3—3 of FIG. 2.
Figure 4:
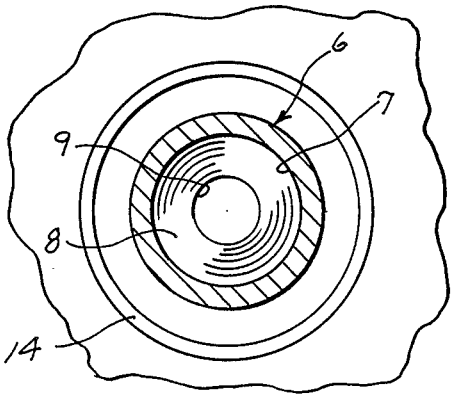
FIG. 4 is a section taken along line 4—4 of FIG. 2.

The drawings illustrate a liquid heating apparatus including a housing 1 having a liquid or water inlet 2 and a vapor or steam inlet 3, which is located beneath the level of the liquid inlet 2.

The lower end of housing 1 is elongated, as indicated by 4, and an overflow outlet 5 is provided centrally of the length of the lower section 4.

Mounted for sliding movement within housing 1 is a tubular nozzle 6 having an axial passage 7. The lower or downstream end 8 of the nozzle 6 converges and terminates in a small diameter outlet 9.

The upper portion of nozzle 6 is generally cylindrical, as indicated by 10, and is adapted to slide within a tubular sleeve 11 composed of a material having a low coefficient of friction, such as nylon or Teflon. The interface between nozzle 6 and sleeve 11 is sealed by an O-ring **11*a* disposed in a groove in the nozzle. The lower end of sleeve 11 bears against an internal shoulder 12 in housing 1, and the sleeve 11 is retained in position within the housing by a retaining ring 13 which is mounted within an internal groove in housing 1** and engages the upper end of the sleeve.

Located within the lower section 4 of housing 1 is a tubular member 14 and the upper end of tubular member 14 is formed with a shoulder 15 which bears against an internal ledge 16 in housing 1. A nut 17 is threaded onto the lower end of housing section 4. A discharge conduit 18 is threadedly connected to nut 17 and communicates with the interior of member 14. The upper end of discharge conduit 18 bears against the lower end of tubular member 14 to retain tubular member 14 within housing 1.

Figure 2:
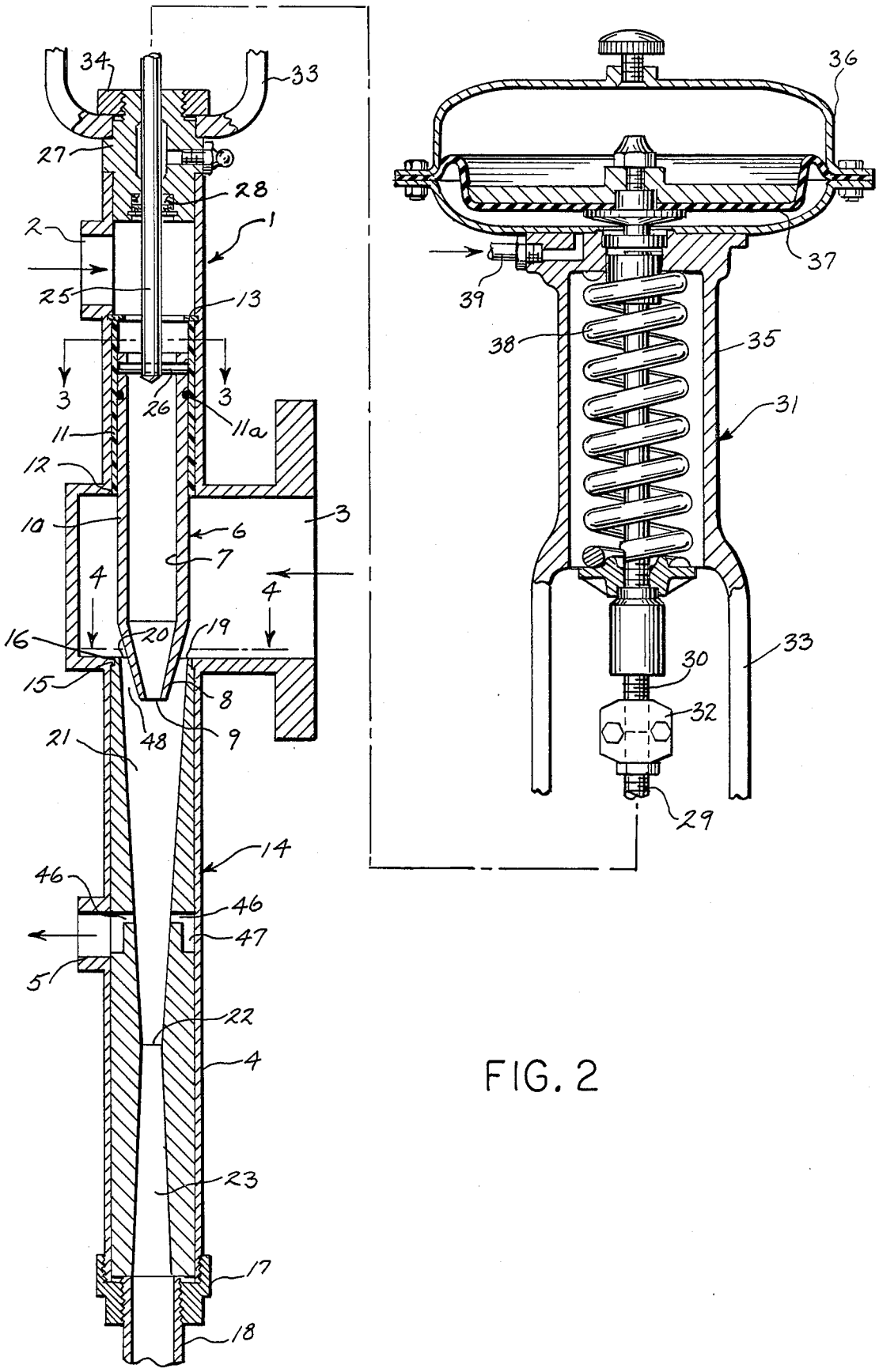
FIG. 2 is a side elevation with parts broken away in section of the heating apparatus.

As best shown in FIG. 2, the upper end of tubular member 14 defines an annular seat 19, which in normal operation of the apparatus is spaced from the converging end 8 of nozzle 6 to provide an annular opening or passage 20 which communicates with the steam inlet 3. By varying the position of nozzle 6 within housing 1, as will be hereinafter described, the cross-sectional area of the annular passage 20 can be correspondingly varied.

The upper end of tubular member 14 defines a downwardly converging mixing chamber 21, the lower end of which constitutes an aperture 22 having a cross sectional area substantially equal to the cross sectional area of nozzle outlet 9. Located downstream of orifice 22 is a downwardly diverging diffuser 23, which communicates with the discharge conduit 18.

To move nozzle 6 axially within housing 1, a rod 25 is connected to the upper end of the nozzle by a cross pin 26. Cross pin 26 extends within an opening in the lower end of rod 25, as well as through aligned openings in the wall of nozzle 6.

Rod 25 extends upwardly through an axial opening in head 27, which is threaded to the upper end of housing 1, and a seal assembly 28 is mounted within a recess in head 27 and serves to seal the joint between rod 25 and head 27.

The upper threaded end 29 of rod 25 is connected to the lower threaded end of a rod 30 of pneumatic actuator 31 by a connector 32. Actuator 31, in itself, is of conventional construction and may be of the type sold by Fisher Controls under Model 667. In general, actuator 31 includes a yoke 33 which is mounted on head 27 and is retained thereon by nut 34. The upper end of yoke 33 is integrally formed with tubular body 35 and a diaphragm housing 36 is mounted on the upper end of body 35. Mounted within housing 36 is a diaphragm 37 that is biased to the position shown in FIG. 2, by a coil spring 38 which is mounted within body 35. The upper end of spring 38 bears against the upper end of body 35, while the lower end of the spring is connected to rod 30 so that the force of the spring acts to bias the diaphragm 37 downwardly. A fluid, such as air, is adapted to be admitted into the lower portion of housing 36 through an inlet 39 and the pressure of the air acting against the underside of the diaphragm will flex the diaphragm upwardly against the force of spring 38 to thereby move the rod 25 and nozzle 6 upwardly within the housing and open the steam outlet 20.

Actuator 31 is operated by a temperature sensing system. A thermostat or temperature sensor 40 is mounted in discharge conduit 18 and is connected through sensing leads 41 to a temperature controller 42. An air line 43 connects the temperature controller with a source of air or gas under pressure, while a second line 44 connects the temperature controller with the inlet opening 39 of the actuator 31. Valve 45 is located in line 44.

If the temperature of the liquid being discharged through conduit 18, as sensed by sensor 40, falls below a predetermined value, a signal is generated by temperature controller 44 to admit air to the actuator 31 to thereby vary the position of nozzle 6 within housing 1 to increase the cross-sectional area of opening 20 and increase the mass flow rate of steam entering the mixing chamber 21. Conversely, the temperatures above the predetermined volume, actuator 31 is moved so as to decrease the mass flow rate of steam entering mixing chambers 21.

At the beginning of operation, liquid and steam can be admitted to the mixing chamber 21 and can overflow through outlet 5 until the condensing steam sufficiently accelerates the stream of liquid being discharged from nozzle 6, so that the high velocity stream will be free flowing through the aperture 22. As shown in FIG. 2, tubular member 14 is provided with a plurality of radial ports 46 that provide communication between mixing chamber 21 and a circumferential groove 47. Groove 47 is connected to outlet 5.

As the steam or vapor passes through passage 20 it enters the diverging chamber 48, defined by nozzle end 8 and the wall of tubular member 14. The steam will expand and tend to condense in chamber 48, producing a negative pressure to aid in drawing or aspirating steam through the annular passage 20. The steam expanding into chamber 48 accelerates to sonic or supersonic velocity and as the steam passes the nozzle outlet 9, it will contact the stream of water exiting the downstream end 8 of nozzle 6 at outlet 9, causing the steam to condense and transfer its momentum energy to the water stream. A substantial portion of the steam will condense by the time the liquid stream reaches the aperture 22. After passing through the aperture 22, the liquid stream passes into the diffuser section 23 where the liquid will decrease its velocity and increase its pressure.

Temperature sensor 40 will act to control operation of the actuator 31 to regulate the cross sectional area of the steam passage 20 to maintain a substantially constant outlet temperature for the discharged liquid.

The apparatus of the invention enables low pressure vapor or steam to be effectively utilized to heat a liquid. Through use of the apparatus, an incoming liquid at any temperature can be effectively heated to a temperature approximating that of the incoming steam.

The apparatus of the invention has particular use in situations where the liquid pressure in an industrial plant may be higher than the residual steam pressure, normally making other heating systems ineffective and resulting in the discard of the residual steam.

Various modes of carrying out the invention are contemplated as being within the scope of the following claims particularly pointing out and distinctly claiming the subject matter which is regarded as the invention.

I claim:

1. A liquid heating apparatus, comprising a housing having a tubular portion, a liquid nozzle mounted for axial movement in said tubular portion and having a liquid inlet at one end and a liquid outlet at the opposite end, an internal annular seat disposed in said housing downstream of said tubular portion, said nozzle being disposed to move relative to said seat to vary the cross sectional area of an annular passage disposed between said nozzle and said seat, liquid supply means connected to the liquid inlet for supplying liquid to be heated to said nozzle, vapor supply means connected to said housing between said tubular portion and said seat and communicating with said annular passage for supplying a condensable vapor to said annular passage, a diverging annular chamber extending downstream from said passage and surrounding said nozzle, a converging mixing chamber extending downstream from said liquid outlet and communicating with said diverging annular chamber, a diverging diffusion chamber extending downstream from said mixing chamber, discharge conduit means communicating with the downstream end of said diffusion chamber, fluid operated means including a reciprocating member operably connected to said liquid nozzle for moving said nozzle axially of said tubular portion to vary the cross sectional area of said passage, temperature sensing means disposed in said discharge conduit for sensing the temperature of said liquid in said discharge conduit, and means operably connected to said temperature sensing means and responsive to the temperature of the discharged liquid for controlling the flow of fluid to said fluid operated means to thereby move said reciprocating member axially of said housing to vary the cross sectional area of said passage and correspondingly vary the mass flow rate of vapor being introduced through said passage to maintain a predetermined temperature in said discharged liquid.

2. The apparatus of claim 1, and including an overflow outlet communicating with said mixing chamber.

3. The apparatus of claim 1, wherein said housing includes an elongated lower section, and a tubular member disposed within said elongated section and defining said mixing chamber and said diffuser chamber, and retaining means for retaining said tubular member within said housing.

4. A liquid heating apparatus, comprising a housing, a liquid nozzle mounted for axial movement in said housing and having a liquid outlet and a liquid inlet in the opposite end, an internal annular seat in said housing, said nozzle being disposed to move relative to said seat to vary the cross sectional area of the annular passage between said nozzle and said seat, liquid supply means connected to a source of liquid to be heated, vapor supply means disposed upstream of said seat and communicating with said annular passage for supplying a condensable vapor to said passage, a diverging annular chamber extending downstream from said passage and surrounding said nozzle, a converging mixing chamber extending downstream from said liquid outlet and communicating with said diverging annular chamber, a diverging diffusion chamber extending downstream from said mixing chamber, discharge conduit means communicating with the downstream end of said diffusion chamber, power operated means including a reciprocating member mounted for reciprocal movement in a direction parallel to the axis of said nozzle, said reciprocating member being disposed concentrically of said inlet end and spaced radially inward of said inlet end to provide a clearance therebetween, said closure providing communication between said liquid supply means and said inlet end, and connecting means for connecting said reciprocating member to said nozzle.

5. A liquid heating apparatus, comprising a housing, a liquid nozzle mounted for axial movement in said housing and having a liquid outlet and having an inlet end opposite said outlet, an internal annular seat in said housing, said nozzle being disposed to move relative to said seat to vary the cross sectional area of the annular passage between said nozzle and said seat, liquid supply means connected to said nozzle for supplying liquid to be heated to said nozzle, vapor supply meand disposed upstream of said seat and communicating with said annular passage, a diverging annular chamber extending downstream from said passage and surrounding said nozzle, a converging mixing chamber extending downstream from said liquid outlet and communicating with said diverging annular chamber, a diverging diffusion chamber extending downstream from said mixing chamber, discharge conduit means communicating with the downstream end of said diffusion chamber, fluid operated means operably connected to said liquid nozzle for moving said nozzle axially within the housing to vary the cross sectional area of said passage, and means responsive to a temperature difference from a preset temperature of liquid in said discharge conduit for generating a signal to operate said fluid operated means to thereby vary said cross sectional area and maintain a substantially uniform temperature for the liquid in said discharge conduit, said fluid operated means comprising a reciprocating member mounted for reciprocating movement in a direction parallel to the axis of said nozzle, said reciprocating member being disposed within said inlet end and spaced radially of said inlet end to provide an annular clearance therebetween, said clearance communicating with said liquid supply means, and connecting means for connecting said reciprocating member to said inlet end.

* * * * *

UNITED STATES PATENT AND TRADEMARK OFFICE

CERTIFICATE OF CORRECTION

PATENT NO. : 4,773,827

DATED : September 27, 1988

INVENTOR(S) : GARY C. ZAISER

It is certified that error appears in the above-identified patent and that said Letters Patent is hereby corrected as shown below:

| | |
|---|---|
| Col. 6, Line 5, CLAIM 4 | Delete "closure" and substitute therefor ---clearance--- |
| Col. 6, Line 17, CLAIM 5 | Delete "meand" and substitute therefor ---means--- |

Signed and Sealed this

Twenty-fourth Day of October, 1989

*Attest:*

DONALD J. QUIGG

*Attesting Officer*

*Commissioner of Patents and Trademarks*